US006082022A

United States Patent [19]

St. Louis

[11] Patent Number: 6,082,022

[45] Date of Patent: Jul. 4, 2000

[54] CLOTHES DRYER DRUM REAR END HEAD

[75] Inventor: Robert Maurice St. Louis, St. Leonard, Canada

[73] Assignee: Camco Inc., Canada

[21] Appl. No.: 09/305,310

[22] Filed: May 5, 1999

[51] Int. Cl.[7] ..... F26B 11/02

[52] U.S. Cl. ..... 34/602; 34/603; 34/606

[58] Field of Search ..... 34/602, 603, 604, 34/606, 608, 609

[56] References Cited

U.S. PATENT DOCUMENTS

| | | | |
|---|---|---|---|
| 3,060,593 | 10/1962 | Flora et al. | 34/133 |
| 3,333,346 | 8/1967 | Brucken | 34/131 |
| 3,483,632 | 12/1969 | Triplett | 34/133 |
| 3,974,573 | 8/1976 | Daily et al. | 34/48 |
| 4,628,617 | 12/1986 | St. Louis | 34/108 |
| 4,689,896 | 9/1987 | Narang | 34/82 |
| 4,765,162 | 8/1988 | Ouellette | 68/20 |
| 4,854,054 | 8/1989 | Johnson | 34/133 |
| 5,062,219 | 11/1991 | Harris et al. | 34/133 |
| 5,771,604 | 6/1998 | Wunderlich et al. | 34/603 |

*Primary Examiner*—Denise L Ferensic
*Assistant Examiner*—Michelle Mattera

[57] ABSTRACT

A clothes dryer having a rear end head with axially spaced apart apertures through which air may enter into the dryer drum through a diffuser wall mounted to the inside of the drum end head. The apertures in the end head have an air flow deflection shield integrally formed therewith. The air flow deflection shield extends radially across the apertures in the end head, is recessed from the rear end head and is spaced from the diffuser wall. Advantage is found with the use of such an air flow deflection shield because it permits for the apertures in the rear head to be of sufficient size to permit satisfactory air flow into the dryer drum while deflecting the air away from potential warm spots generated through and on the surface of the diffuser wall that would otherwise be in direct immediate air flow impingement with the apertures in the end head.

19 Claims, 5 Drawing Sheets

CLOTHES DRYER DRUM REAR END HEAD

FIELD OF THE INVENTION

This invention relates to a clothes dryer having a rotating drum and in particular relates to air flow through the rear head of the rotating dryer drum.

BACKGROUND OF THE INVENTION

In the construction of clothes dryers for drying clothes and other articles, it is common practice to provide a rotating drum in which the clothes articles are placed. The rotating drum tumbles the clothes within the drum as air passes across the clothes removing moisture from the clothes. The air entering the dryer typically enters through apertures or air passages in the rear end head of the dryer which structurally closes off the rear end of the drum. A diffuser wall is secured across the end head and has a series of apertures distributed over the diffuser wall so as to evenly distribute air entering the dryer drum.

One such end head is shown in my U.S. Pat. No. 4,628,617 issued Dec. 16, 1986. In this patent, the rear end head is shown to have a series of enlarged circular apertures axially spaced about the rear end head. While this design permits for the entry of air into the dryer drum, it should be understood, that during certain periods of the cycle operation of the clothes dryer, the air entering the drum will be warmer than at other times. In the air flow characteristics of this drum, the air has a tendency to move directly through the apertures of the end head in a straight line fashion through the series of holes in the diffuser wall and into the dryer drum. This results in localized areas on the diffuser wall being much warmer than other areas. These localized hotter areas have a tendency, when contacting the clothes, to damage certain types of fabrics.

While it has been known to adjust the pattern of the apertures in the diffuser wall and the location of these apertures, there is still direct impingement of the air entering through the end head apertures onto the diffuser wall which results in localized heating of the diffuser wall. Further, the size of the apertures in the end head must be sufficiently large to permit for satisfactory air flow into the dryer drum without increasing unduly the power requirements of the blower motor associated with the clothes dryer.

Accordingly, there is a need for the development of a clothes dryer having a rear end head with relatively large apertures permitting for satisfactory air flow into the clothes dryer while at the same time avoiding or reducing the adverse effects of the direct impingement of warm air creating localized warm areas on the rear surface of the diffuser wall.

SUMMARY OF THE INVENTION

It is an object of the present invention to provide a clothes dryer having a rear end head with improved air flow entering the dryer drum through a diffuser wall of the dryer drum.

The present invention relates to a clothes dryer having a rotatable drum for receiving articles to be dried. The clothes dryer has a rear end head structurally closing one end of the drum. A diffuser wall is mounted adjacent to the rear end head inside the dryer drum. The diffuser wall has a pattern of apertures extending across the diffuser wall for allowing air to enter the dryer drum relatively evenly from the diffuser wall surface. The rear end head has a plurality of axially spaced apart apertures which are larger than the apertures in the diffuser wall. The improvement comprises an air flow deflection shield extending across the center of each of the apertures in the rear end head to deflect air passing through these apertures away from the center of these apertures. The provision of such a shield located across the apertures of the end head, effectively deflects at least a portion of warm air that would otherwise directly impinge on the diffuser wall.

The air flow deflection shield preferably extends radially across the aperture in the end head and is recessed from the rear end head towards the diffuser wall and is spaced from the diffuser wall. This permits for the air to pass through the larger apertures in the rear end head and to be deflected by an air flow deflection shield which is spaced from the diffuser wall reducing direct impingement with the diffuser wall. Consequently, if the air flow deflection shield warms as a result of its function, this is of no consequence to the fabrics being dried in the dryer drum because the shield is not in contact with the diffuser wall.

The air flow deflection shield preferably has a convex curvature along its radial extension to deflect air flow passing through the apertures in the rear end head radially inward and outward. Particularly the deflection of the air flow radially outward towards the peripheral surfaces of the rear diffuser wall provides the advantage of allowing the air flow to more evenly distribute itself through the apertures in the rear diffuser wall.

The air flow deflection shield is preferably formed integrally with the rear end head by being stamped therefrom. The apertures in the rear end head preferably define diverging elongate first side edges and the air flow shield has a central portion with radially outwardly diverging second side edges spaced from the first side edges to define first air flow passages. The air flow shield has third side edges defining narrow end strips extending from the central portion of the shield that join with the rear end head. The narrow end strips define wider second air flow passages with adjacent edges of the end head which passages are wider than the first air flow passages. These second end passages are located at the radial ends of the shield so that air is deflected radially by the shield.

Another aspect of the present invention is that the pattern of apertures on the diffuser wall extend in a radially outward pattern on the diffuser wall wherein the size of these apertures are variable and increase with the apertures that are located further radially outward from the center of the diffuser wall. As a result, there is less resistance to air flow passing through the outer peripheral portions of the diffuser wall allowing for a greater air flow towards the radial periphery of the diffuser wall.

In accordance with another aspect of the present invention, the diffuser wall has a peripheral rim that is mounted to and spaced from the peripheral rim such that a peripheral air gap exists through which air flows into the dryer drum.

BRIEF DESCRIPTION OF THE DRAWINGS

For a better understanding of the nature and objects of the present invention, reference may be had to the accompanying diagrammatic drawings in which.

DETAILED DESCRIPTION OF THE PREFERRED EMBODIMENT

Figure 1:
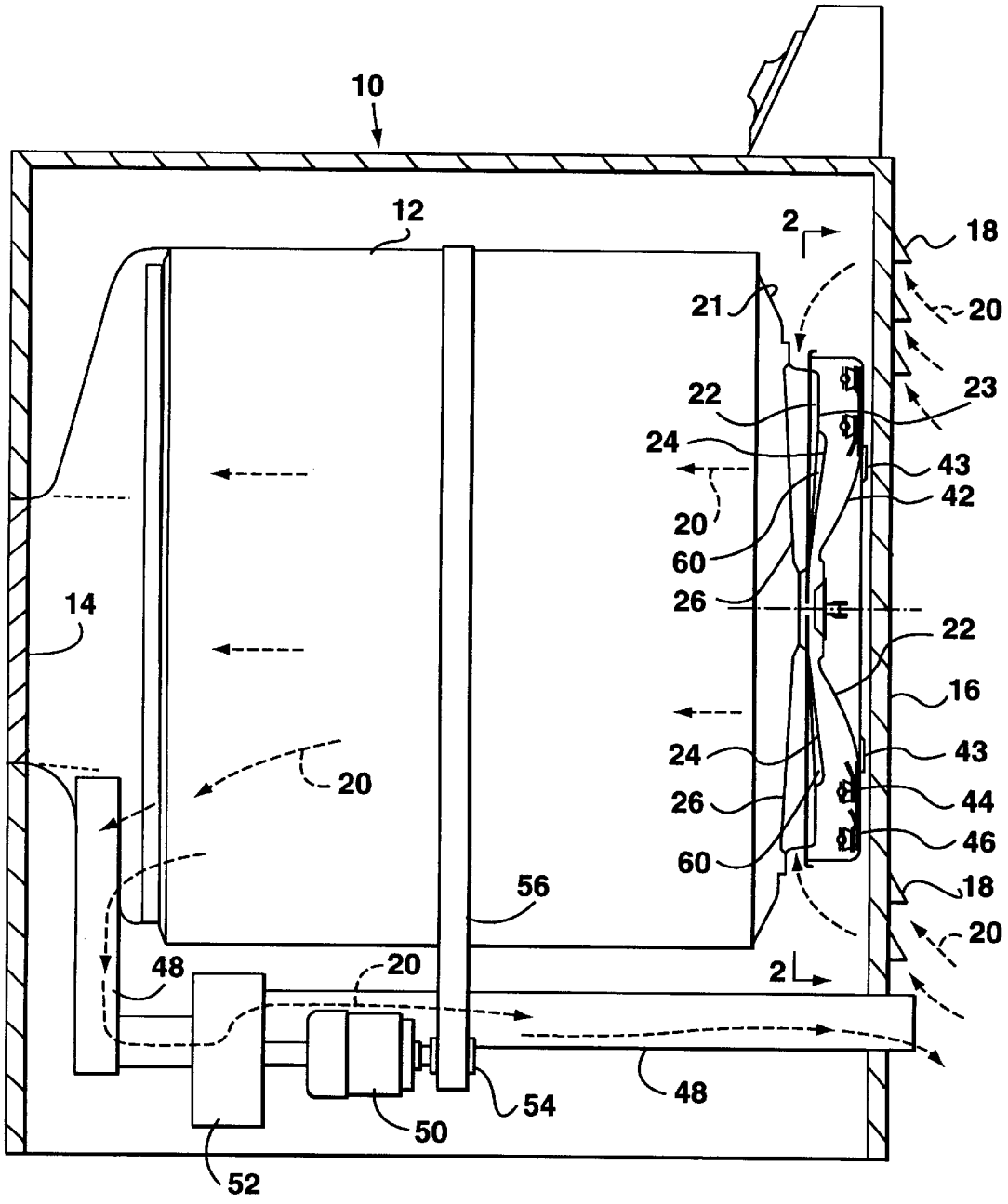
FIG. 1 is a view showing an electric clothes dryer having a rotating drum, rear end head and a diffuser wall of the present invention.

Referring to FIG. 1 there is shown a clothes dryer 10 having a rotatable dryer drum 12 mounted within the clothes dryer 10. Access for placing clothes into the drum 12 may be gained through the door 14. The rear panel 16 of the dryer 10 has a plurality of louvers or openings 18 through which air may enter the dryer 10 and follow the path through dryer 10 as shown by broken arrows 20.

Referring to FIGS. 1 to 4, the dryer drum is closed at its rear end by a rear end head 22. The rear end head 22 is structurally attached at its outer peripheral edge 21 to the dryer drum 12. The rear end head 22 has a relatively flat surface 23 provided with a series of radially extending apertures 24 which permit for air flow through the end head and into the dryer drum.

Figure 2:
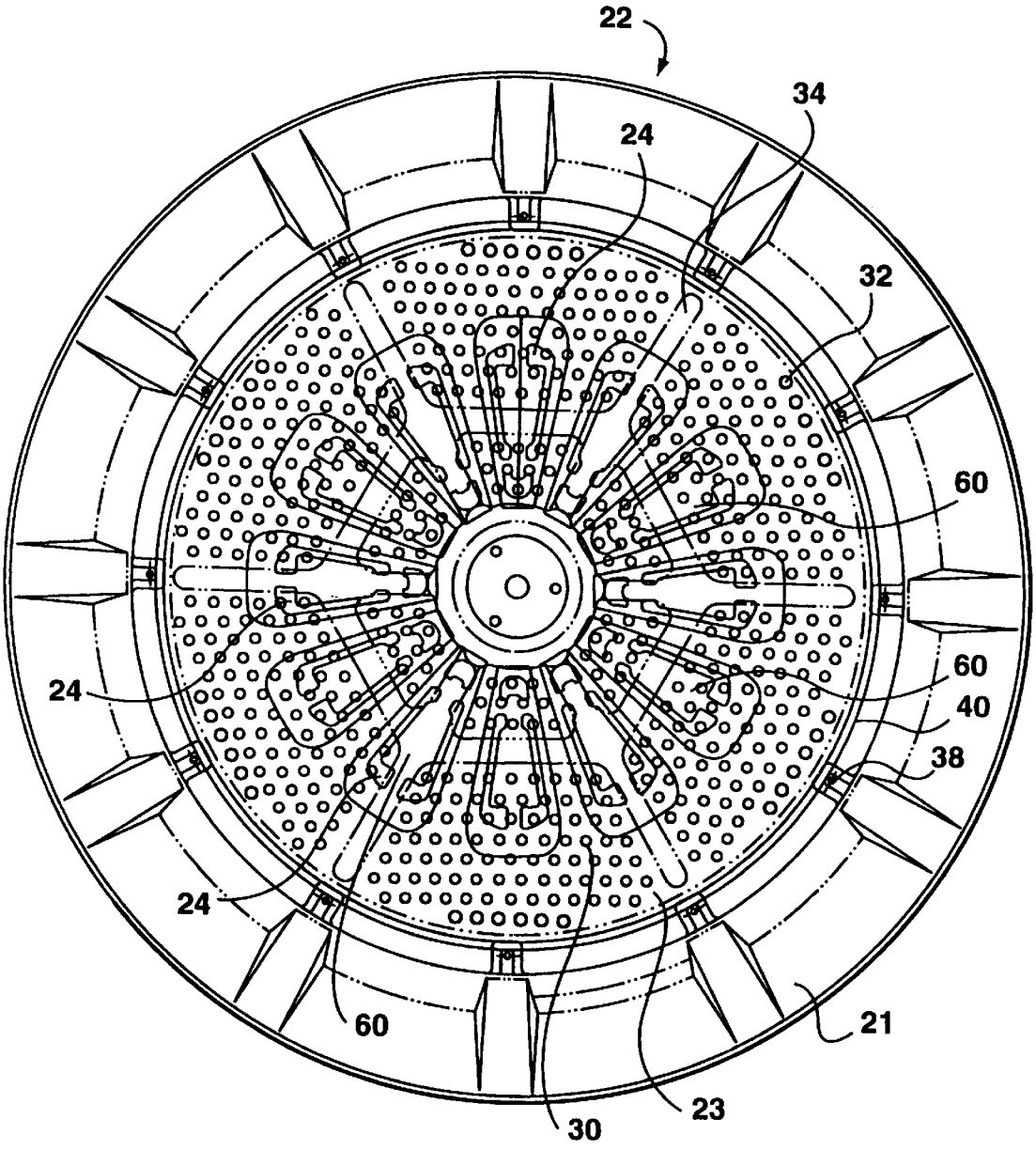
FIG. 2 is a rear view of the end head structure as seen from lines 2—2 of FIG. 1.
Figure 5:
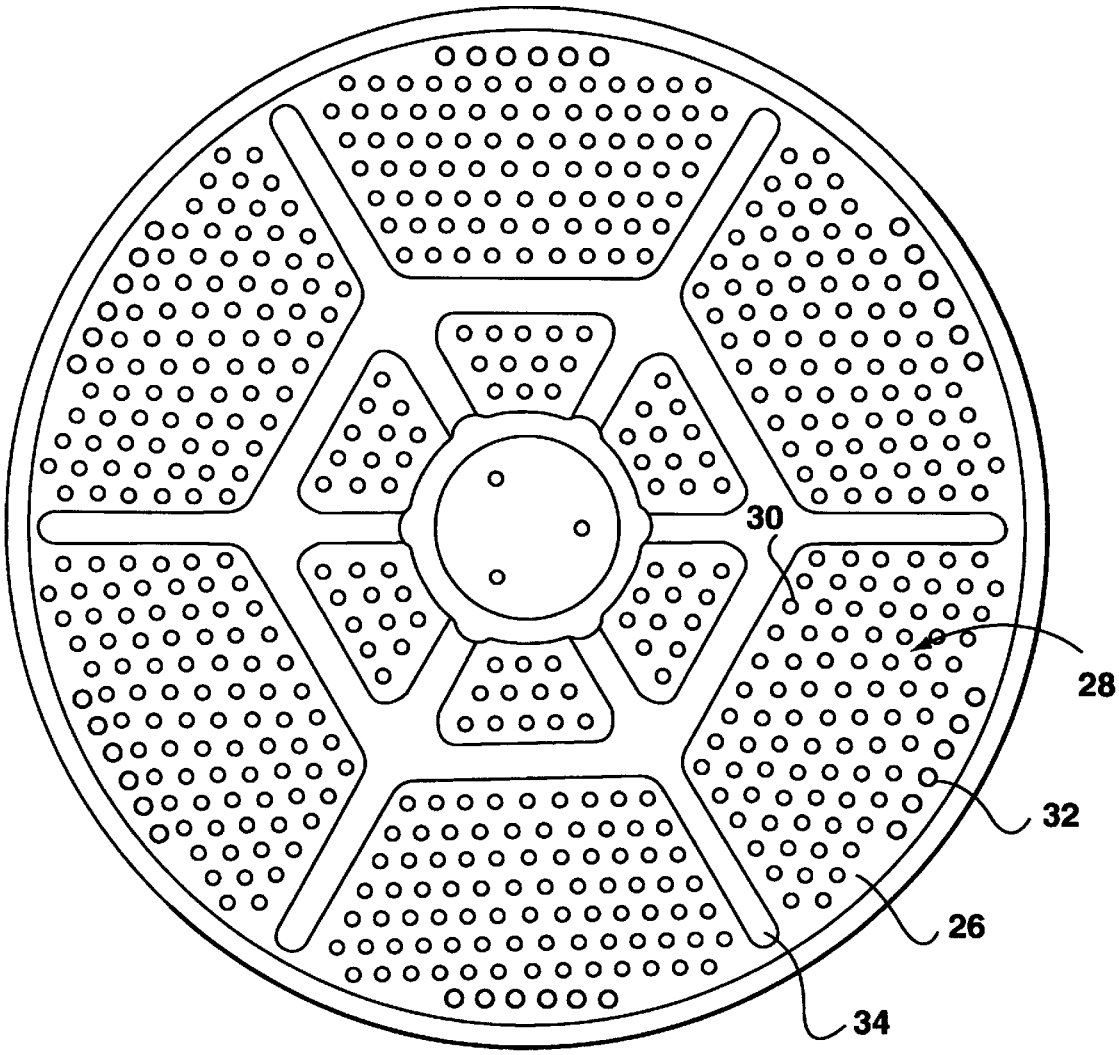

Air passing through the apertures 24 in the rear end head 22 then passes through diffuser wall 26. The diffuser wall is best seen in FIGS. 2 and 5 wherein the diffuser wall 26 includes a pattern of apertures 28 that extend radially from the center of the diffuser wall 26. The pattern of apertures 28 are shown to include a series of smaller apertures 30 located radially inward of larger apertures 32 located towards the outer peripheral edge of the diffuser wall 26. The diffuser wall 26 has an integral pattern 34 which provides for the necessary stability in the diffuser wall housing. The diffuser wall housing 26 is mounted (see FIG. 2) by a series of bosses 38 to the end head 22. This placement allows for an air gap 40 to be located adjacent the peripheral edge of the diffuser wall 26 and the rear end head 22. Generally, the size of the openings or apertures 30 and 32 in the pattern of apertures 28 of the diffuser wall 26 are smaller than the size of the apertures 24 in the rear end head 22.

It is through apertures 24, 30, and 32, and air gap 40 that air flow 20 enters the dryer drum 12. The air entering the dryer drum 20 is heated by a heater housing assembly 42 located behind the rear end head 32. The heater housing 42 is mounted by bolts 43 to the rear panel 16. The heater housing assembly 42 is stationary and permits the dryer end head 22 to rotate within or relative to the heater housing 42. The heater housing 42 is provided with heating coils 44 mounted on electrical insulators 46 to the heater housing 42. Air passing 20 over the heating coils 44 is warmed during warming cycles of the dryer. As the air 20 passes through the dryer drum 12 it exits the front end of the dryer through ducting 48 and out of the ducting 48 towards the rear panel of the dryer 16. Continuous air flow through the dryer drum 12 is accomplished by the use of a motor 50 which drives a fan 52 located in the ducting 48. This fan or blower forces the air out of the ducting 48. The motor 50 is also connected with a shaft pulley 54 and a belt 56 tensioned about the dryer drum 12 to effect rotation of the dryer drum.

Figure 3:
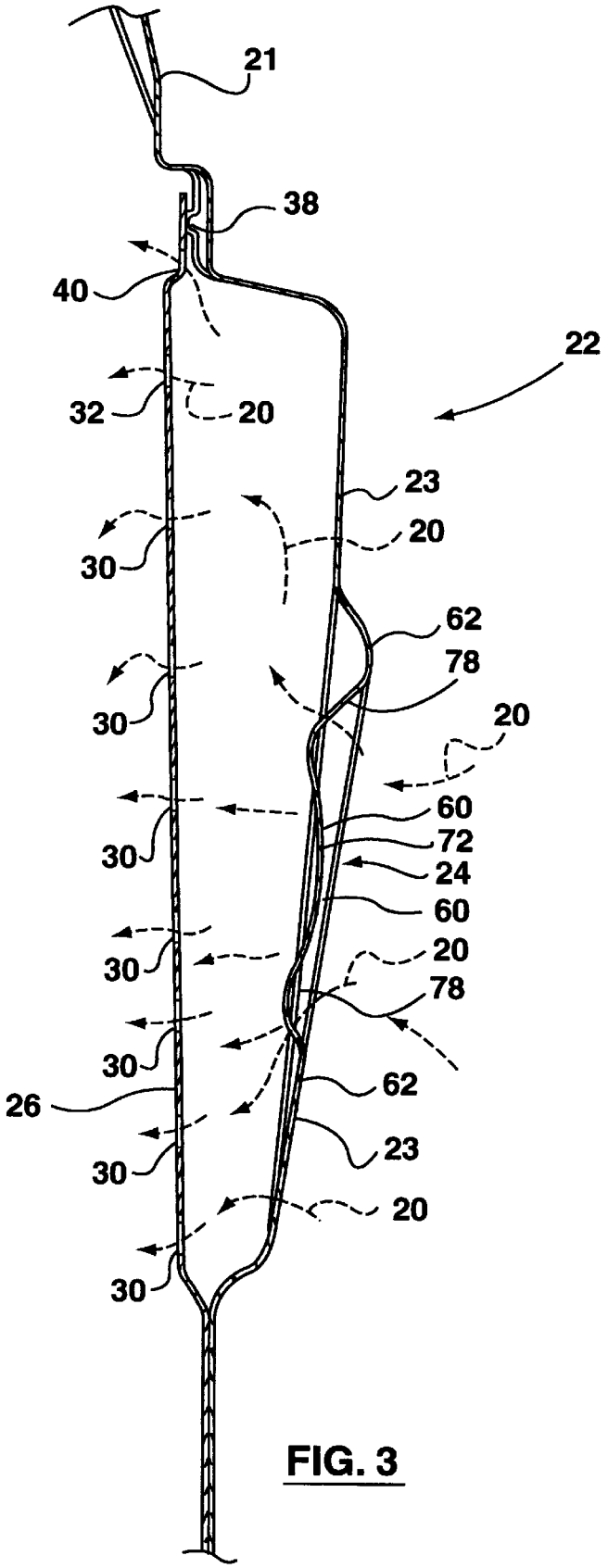
FIG. 3 is and enlarged side sectional view of a portion of the rear end head of the dryer drum.
Figure 4:
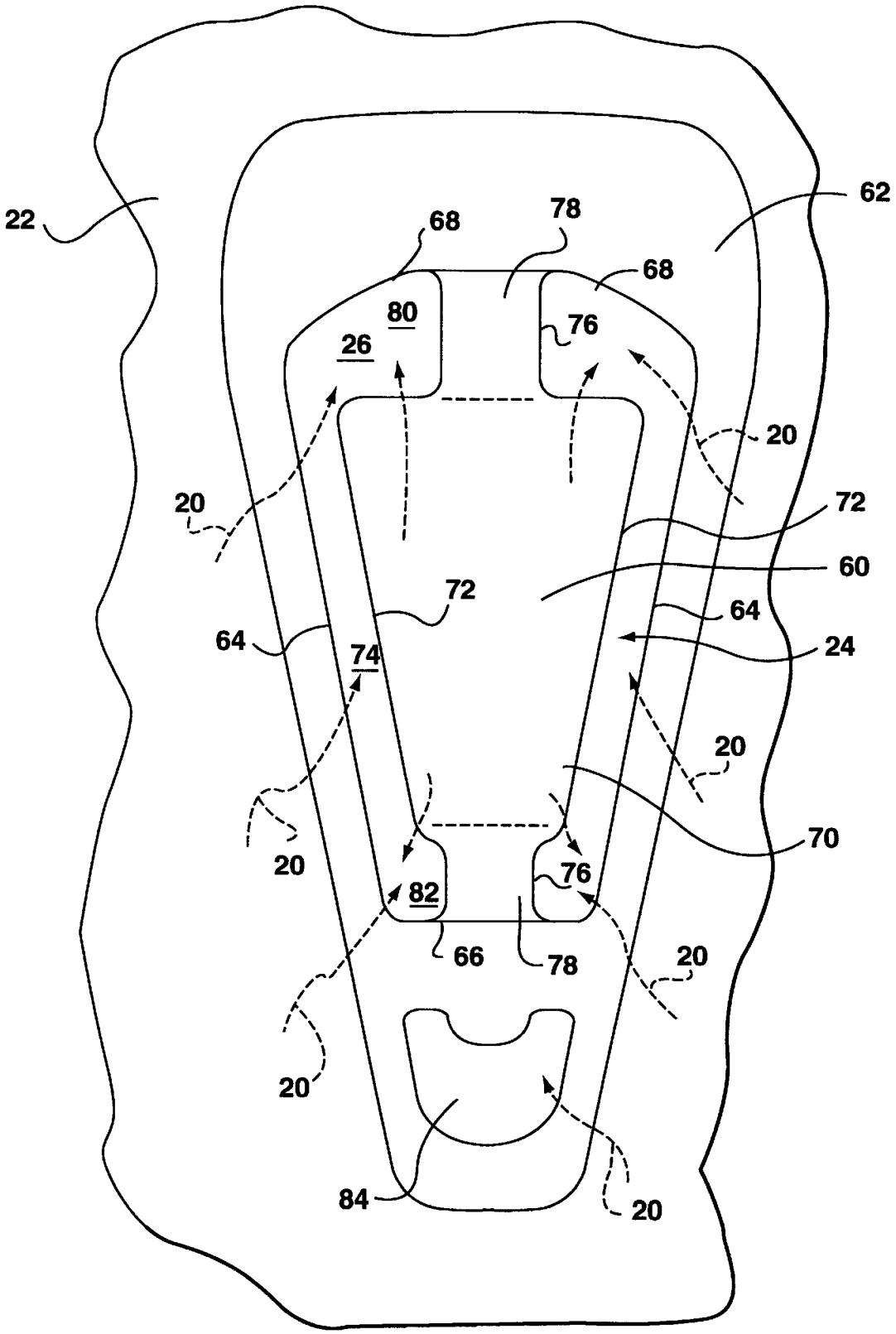
FIG. 4 is an end view of the portion of the rear end head of the dryer drum of FIG. 3.; and, FIG. 5 is a front view of the diffuser wall.

Referring now to FIGS. 2 to 4, there is shown the improved air flow deflection shield 60. The air shield 60 spans the center of the aperture 24 in the end head 22 so as to deflect air radially of the apertures 24 and prevent air entering aperture 24 from coming in to direct contact with diffuser wall 26. Aperture 24 is stamped out from raised portion 62 of the end head 22. The aperture 62 extends generally radially outward from the center of the end head structure and is provided with two elongate diverging sidewalls 64.

The aperture 64 is provided with a relatively straight lower edge 66 and defines a curved upper edge 68.

The air deflection shield 60 spans the center of the aperture 24 and is integrally formed along portions of edges 66 and 68 with the raised portion 62 of the rear end head 22. The air flow deflection shield 60 has a central portion 70 having two elongate generally radially and diverging sidewalls 72. The sidewalls 72 are parallel to the side edges 64.

A first air passage 74 is defined between the side edges 64 and parallel sides 72 of the air shield 60. This allows for air to flow through passage 74. The ends 78 of the shield 60 have narrower side edges 76 defining narrow end strips 78 which extend from the central portion 70 of the shield 60 and join the shield 60 with the rear end head 23 at the edges 66 and 68. The narrower end strips 78 result in wider air flow passages 80 and 82 located at the radial ends of the aperture 24 from the first air flow passage 74. Furthermore, the air flow passage 80 is wider than the air flow passage 82 and is located radially outwardly the most as compared to air flow passages 74 and 82. This permits for less resistance to air flow through these larger radial end passages and particularly the radial outward passage 80 providing for a more increased air flow towards the peripheral edges of the diffuser wall 26. It should be understood also that an additional aperture 84 is located below aperture 24 in the stamped out portion 62 of the end head 22. Opening or aperture 84 allows for air flow 20 closer to the center of the diffuser wall 26.

Referring to FIGS. 3 and 4, the air flow deflection shield 60 extends radially across the aperture 24 and is recessed by the bent end strips 78 back into the space between the diffuser wall 26 and the end head 22. The center portion 70 of the air flow deflection shield 60 has a convex shape along its radial extension which results in more air flow deflection radially upward into passages 80 and downward into passages 82. This permits for more even air flow distribution away from the apertures 30 directly across from the aperture 24 and out towards the peripheral edges of the diffuser wall 26.

What I claim is:

1. A clothes dryer comprising:

a rotatable drying drum for receiving articles to be dried;

a rear end head structurally closing one end of the drum, the rear end head having a plurality of axially spaced apart first apertures extending radially outward from a center of the rear end head for permitting air flow therethrough;

an air flow deflection shield spanning across the center of each of the first apertures to deflect air passing through the first apertures away from the center of the first aperture;

a diffuser wall mounted adjacent to the rear end head inside the dryer drum, the diffuser wall having a pattern of second apertures extending across the diffuser wall, and the second apertures being smaller than the first apertures in the rear end head to spread the air flow as the air flow passes though the first apertures and the second apertures into dryer drum.

2. The clothes dryer of claim 1 wherein the air flow deflection shield extends radially across the first aperture and has a convex curvature along its radial extension to deflect air flow passing through the first aperture radially inward and outward.

3. The clothes dryer of claim 1 wherein the air flow deflection shield extends radially across the first aperture and is recessed from the rear end head towards the diffuser wall and is spaced in non-contacting relation from the diffuser wall.

4. The clothes dryer of claim 3 wherein the air flow deflection shield has a convex curvature along its radial extension to deflect air flow passing through the first aperture radially inward and outward.

5. The clothes dryer of claim 4 wherein the air flow deflection shield is formed integrally of the rear end head.

6. The clothes dryer of claim 5 wherein the first apertures define diverging elongate first side edges with the rear end head, and the air flow shield has a central portion with radially outwardly diverging second side edges spaced from the first side edges to define first air flow passages therebetween, the air flow shield having third side edges defining narrow end strips extending from the central portion and joining with the rear end head, and the narrow end strips defining wider second to air flow passages with adjacent edges of the first aperture than the first air flow passages.

7. The clothes dryer of claim 6 wherein the narrow end strips of the shield are curved away from the end shield and towards the diffuser wall to recess the central portion of the air flow shield from the first apertures, and the central portion of the air flow shield having the convex curvature.

8. The clothes dryer of claim 6 wherein the second air flow passages are located on opposing radially sides of the first air flow passages and the second air flow passages spaced further radially outward are wider than the other second air flow passages.

9. The clothes dryer of claim 1 wherein the pattern of second apertures extend in a radial outward pattern on the diffuser wall having variable sizes that increase with the further radial outward placement of the second apertures in the pattern.

10. The clothes dryer of claim 9 wherein the air flow deflection shield extends radially across the first aperture, is recessed from the rear end head towards the diffuser wall, and is spaced in non-contacting relation from the diffuser wall, the air flow deflection shield having a convex curvature along its radial extension to deflect air flow passing through the first aperture radially inward and outward.

11. The clothes dryer of claim 10 wherein the air flow deflection shield is formed integrally of the rear end head.

12. The clothes dryer of claim 11 wherein the first apertures define diverging elongate first side edges with the rear end head, and the air flow shield has a central portion with radially outwardly diverging second side edges spaced from the first side edges to define first air flow passages therebetween, the air flow shield having third side edges defining narrow end strips extending from the central portion and joining with the rear end head, and the narrow end strips defining wider second air flow passages with adjacent edges of the first aperture than the first air flow passages.

13. The clothes dryer of claim 12 wherein the narrow end strips of the shield are curved away from the end shield and towards the diffuser wall to recess the central portion of the air flow shield from the first apertures, and the central portion of the air flow shield having the convex curvature.

14. The clothes dryer of claim 1 wherein the diffuser wall has a peripheral rim that is spaced from the rear end head defining a peripheral air gap through which air flows into the dryer drum.

15. The clothes dryer of claim 14 wherein the pattern of second apertures extend in a radial outward pattern on the diffuser wall having variable sizes that increase with the further radial outward placement of the second apertures in the pattern.

16. The clothes dryer of claim 14 wherein the air flow deflection shield extends radially across the first aperture, is recessed from the rear end head towards the diffuser wall and is spaced in non-contacting relation from the diffuser wall, the air flow deflection shield having a convex curvature along its radial extension to deflect air flow passing through the first aperture radially inward and outward.

17. The clothes dryer of claim 16 wherein the air flow deflection shield is formed integrally of the rear end head.

18. The clothes dryer of claim 17 wherein the first apertures define diverging elongate first side edges with the rear end head, and the air flow shield has a central portion with radially outwardly diverging second side edges spaced from the first side edges to define first air flow passages therebetween, the air flow shield having third side edges defining narrow end strips extending from the central portion and joining with the rear end head, and the narrow end strips defining wider second air flow passages with adjacent edges of the first aperture than the first air flow passages.

19. The clothes dryer of claim 18 wherein the narrow end strips of the shield are curved away from the end shield and towards the diffuser wall to recess the central portion of the air flow shield from the first apertures, and the central portion of the air flow shield having the convex curvature.

* * * * *